US008910679B2

(12) United States Patent
Avganim

(10) Patent No.: US 8,910,679 B2
(45) Date of Patent: Dec. 16, 2014

(54) THEFT PROTECTABLE CARRYING BAG IN PARTICULAR FOR PORTABLE COMPUTERS

(76) Inventor: Meir Avganim, Nachal Sorek (IL)

( * ) Notice: Subject to any disclaimer, the term of this patent is extended or adjusted under 35 U.S.C. 154(b) by 232 days.

(21) Appl. No.: 13/262,952

(22) PCT Filed: Mar. 10, 2010

(86) PCT No.: PCT/IL2010/000194

§ 371 (c)(1),
(2), (4) Date: Feb. 7, 2012

(87) PCT Pub. No.: WO2010/116350

PCT Pub. Date: Oct. 14, 2010

(65) Prior Publication Data

US 2012/0125494 A1 May 24, 2012

(30) Foreign Application Priority Data

Apr. 6, 2009 (IL) ..... 198038

(51) Int. Cl.

| | |
|---|---|
| ***B65D 1/00*** | (2006.01) |
| ***A45C 13/20*** | (2006.01) |
| ***E05B 65/52*** | (2006.01) |
| ***E05B 73/00*** | (2006.01) |
| *A44B 19/30* | (2006.01) |
| *A45C 13/10* | (2006.01) |
| *A45C 13/18* | (2006.01) |

(52) U.S. Cl.

CPC ..... *A45C 13/20* (2013.01); *E05B 65/52* (2013.01); *E05B 73/0005* (2013.01); *E05B 73/0082* (2013.01); *A44B 19/301* (2013.01); *A45C 13/103* (2013.01); *A45C 13/18* (2013.01)

USPC ..... 150/101; 150/100; 150/110; 150/102; 383/64; 383/109; 383/5; 383/97; 24/381; 70/68; 70/67

(58) Field of Classification Search

USPC ..... 150/101, 100, 110; 383/64, 109; 24/381

See application file for complete search history.

(56) References Cited

U.S. PATENT DOCUMENTS

| | | | | |
|---|---|---|---|---|
| 4,213,314 | A * | 7/1980 | Trader | 70/68 |
| 6,244,082 | B1 | 6/2001 | Avganim | |
| 7,100,403 | B2 | 9/2006 | Murray, Jr. et al. | |
| 7,111,479 | B2 | 9/2006 | Murray, Jr. et al. | |

(Continued)

FOREIGN PATENT DOCUMENTS

GB 2369990 A 6/2002

OTHER PUBLICATIONS

International search Report dated Jul. 6, 2010, issued in corresponding international application No. PCT/IL2010/000194.

*Primary Examiner* — Fenn Mathew
*Assistant Examiner* — Cynthia Collado
(74) *Attorney, Agent, or Firm* — Ostrolenk Faber LLP

(57) ABSTRACT

A carrying bag (10) with a shoulder-strap (22) and a zipper (14) with zipper-rider (16) for closing/opening the bag. The shoulder-strap (22) is provided with a loop (24) at one end and a key-operated locking device (26) at the other end thereof. Means (36) are provided for fastening the loop (24) to an inside wall of the bag. Means (48) are provided for securing the zipper-rider (16) by the locking device (26) to an outside wall of the bag (10) for preventing the un-zipping of the bag.

8 Claims, 5 Drawing Sheets

(56) References Cited

U.S. PATENT DOCUMENTS 7,367,482 B1 * 5/2008 Witherspoon, Jr. ..... 224/576
7,621,160 B2 * 11/2009 Thomson et al. ..... 70/68
8,499,804 B2 * 8/2013 Schulte ..... 150/102
2006/0016530 A1 * 1/2006 Volk et al. ..... 150/101
2010/0027921 A1 * 2/2010 Thomson et al. ..... 383/64

* cited by examiner

THEFT PROTECTABLE CARRYING BAG IN PARTICULAR FOR PORTABLE COMPUTERS

CROSS-REFERENCE TO RELATED APPLICATIONS

The present application is a 35 U.S.C. §371 National Phase conversion of International Application No. PCT/IL2010/000194, filed Mar. 10, 2010, which claims benefit of Israeli Patent Application No. 198038, filed Apr. 6, 2009, the disclosure of which is incorporated herein by reference. The PCT International Application was published in the English language.

FIELD OF THE INVENTION

The present invention generally relates to carrying bags for valuables, particularly portable computers or the like equipment items of considerable value.

BACKGROUND OF THE INVENTION

Many innovations have been developed in order to protect table- and portable-computers against theft or "snatching": see for example U.S. Pat. Nos. 6,244,082, 7,100,403, 7,111,479.

The most common laptop anti-theft devices are based on a security, steel cable, looped about itself at one end so as to become tied around a table-leg or similar immovable object, whereas the other end is provided with any of various models of key-operated, combination or other types of locks. Mostly, the locking devices were adapted to be secured against a rectangular slot formed (by the manufacturers) at a side wall of the portable computer (sometimes called "designated slot").

Less attention has been dedicated to the protection of side-bags, attaches and trolleys, specifically designed for carrying laptops, that became so vastly used all-over the globe.

It is therefore a major object of the present invention to offer a solution to the problem of stealing portable computers while stored is their transportation facilities, e.g. bags left momentarily unattended in public or semi-public places.

It is a further object of the invention to employ the normally available shoulder-strap of carrying bags as means for securing the bag to an immovable object.

It is a still further object of the invention to equip such shoulder-straps with any of the above-mentioned locking devices so as to be used alternatively to lock the normally available zipper(s) to the bag after being tied to an immovable object, or to function as self-contained means for securing a laptop by its designated slot.

SUMMARY OF THE INVENTION

According to the present invention there is provided a carrying bag with shoulder-strap and zipper with at least one zipper-rider for closing/opening the bag, the shoulder-strap being provided with a loop at one end and a key-operated locking device at the other end thereof, means for fastening the loop to an inside wall of the bag, and means for securing said at-least one zipper-rider by said locking device to an outside wall of the bag for preventing the un-zipping of the bag.

BRIEF DESCRIPTION OF THE DRAWINGS

These and additional constructional features and advantages of the present invention will become more readily understood in the light of the ensuing description of preferred embodiments thereof, given by way of example only, with reference to the accompanying drawings, wherein—

DETAILED DESCRIPTION OF THE PREFERRED EMBODIMENTS

Figure 1:
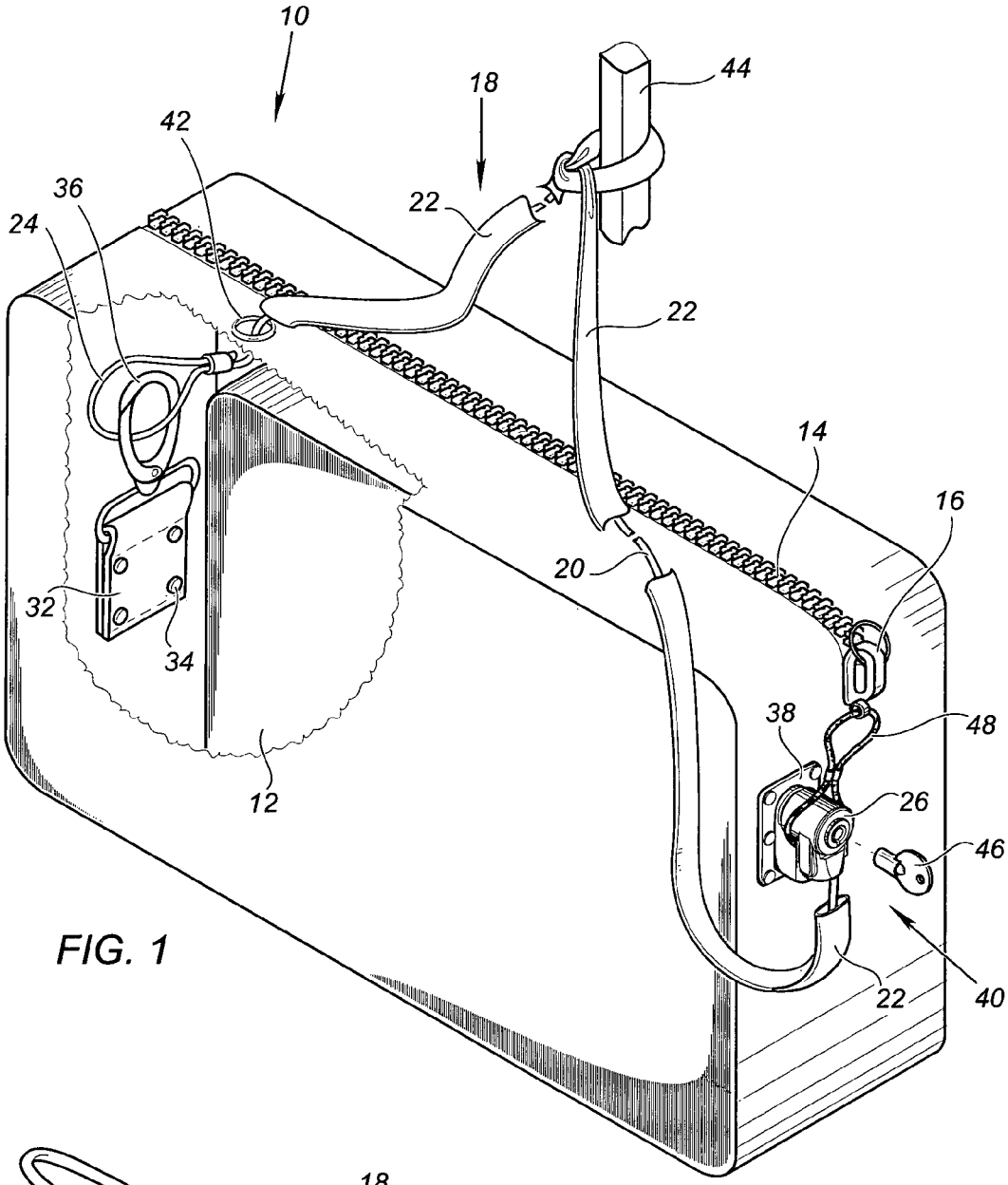
FIG. 1 is a perspective view, partly in cross-section of a carrying bag with shoulder-strap presenting some of the characteristic features of the invention according to a preferred embodiment thereof.

In FIG. 1 there is shown a typical laptop computer carrying bag. The bag generally denoted 10, with computer 12 inside, is closed by zipper 14 having zipper rider 16.

Figure 2:
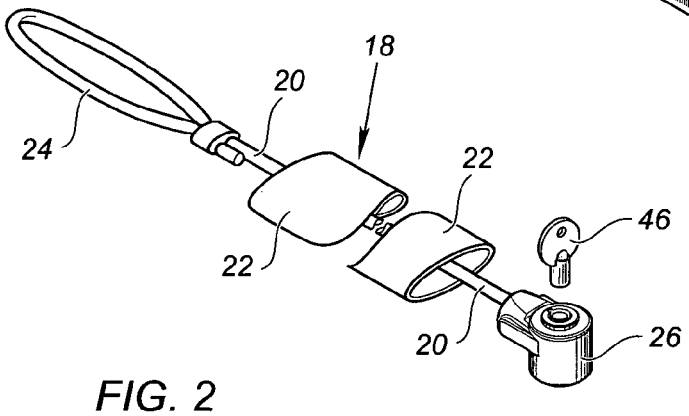
FIG. 2 shows a shoulder-strap such as used in the embodiment of FIG. 1.

A specially designed shoulder-strap 18 is provided (see also FIG. 2). In the exemplified embodiment, a steel-cable 20 is used, passing through an external sheath 22. More advisable, the sheath proper can be made of cloth or canvas, armored by metal or strong plastic threads or fibers woven in the material of the strap.

At one end of the cable 20 a closed loop 24 is formed.

Figure 3A:
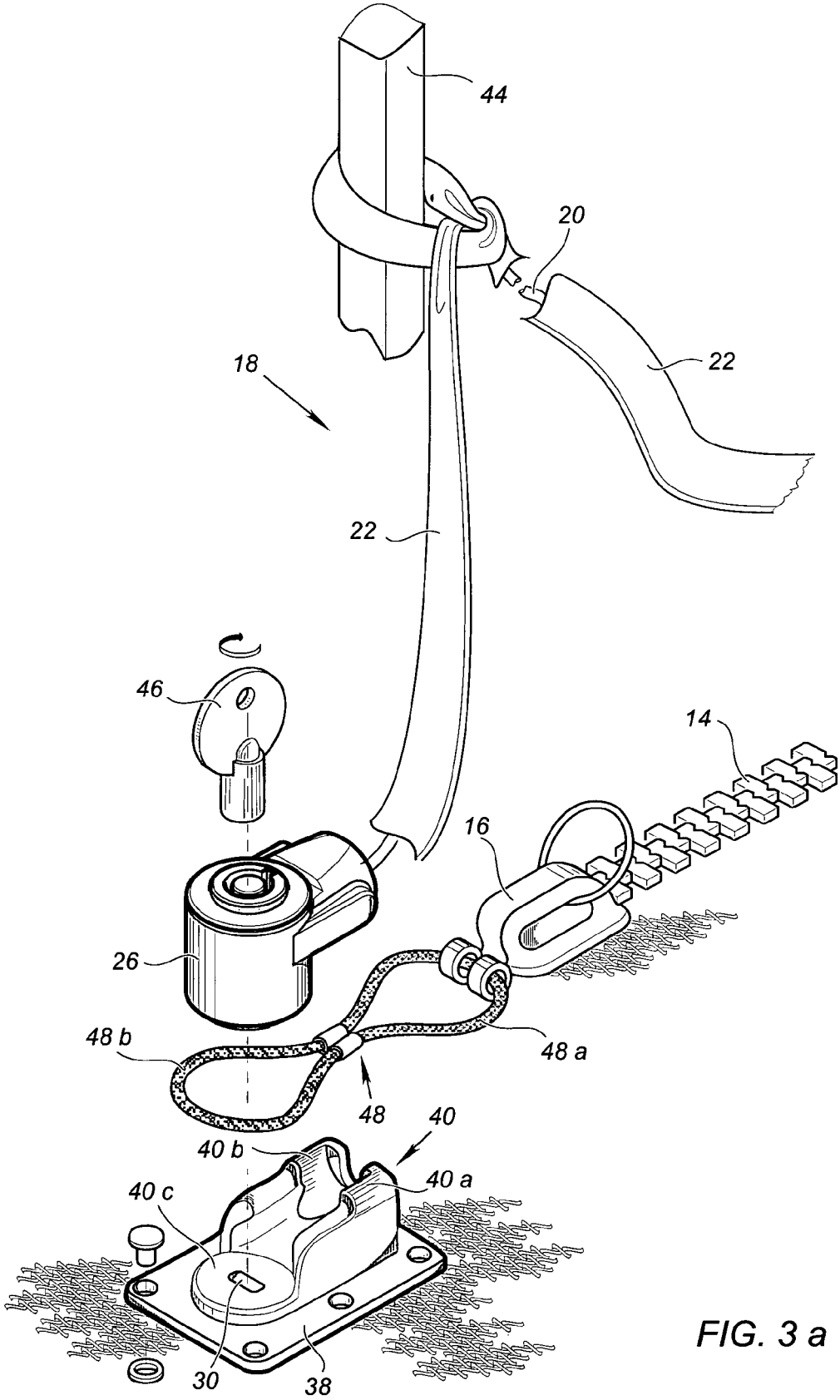
FIG. 3*a* illustrates a preparatory stage of arresting the bag against a fixed object.

At the other end, a key-operated lock 26 is attached, of any type known per-se, such as the push-button type, provided with a rotatable tip 28 (see FIG. 4*b*) insertable into a designated slot 30 (as seen in FIG. 3*a*).

A first base plate 32, made of a rigid material such as sheet metal, is fastened, e.g. by rivets 34 to the inside of a side-wall of the bag 10, configured to support a latch-ring 36 of any conventional type.

A second base plate 38 is riveted to an outer, opposite side-wall of the bag 10. As best seen in FIG. 3*a*, the plate 38 is associated with a protruding, saddle-shaped seat member 40 comprising a pair of ridged portions 40*a* and 40*b* and a flat, somewhat elevated portion 40*c* (namely defined a hollow thereunder) around the designated, rectangular slot 30.

The strap 18 extends through eyelet 42 from the inside of the bag 10 (latch-ring 36 in FIG. 1) to the outside, where it is first tied around an immovable object such as table-leg 44, and then locked by the device 26 against base-plate 38 (rotating the tip 28 behind the slot 30). It will be thus understood that the function of the ridges 40*a* and 40*b* is to prevent a rotational movement of the lock body 26 as a whole by 900, thereby enabling the release of the body in the "locked" position. Moreover, the structure of the saddle-shaped seat member 40 is such that it bears the weight of the bag during carrying on the shoulder of the user, rather than applying the load on the T-shaped tip alone.

Figure 3B:
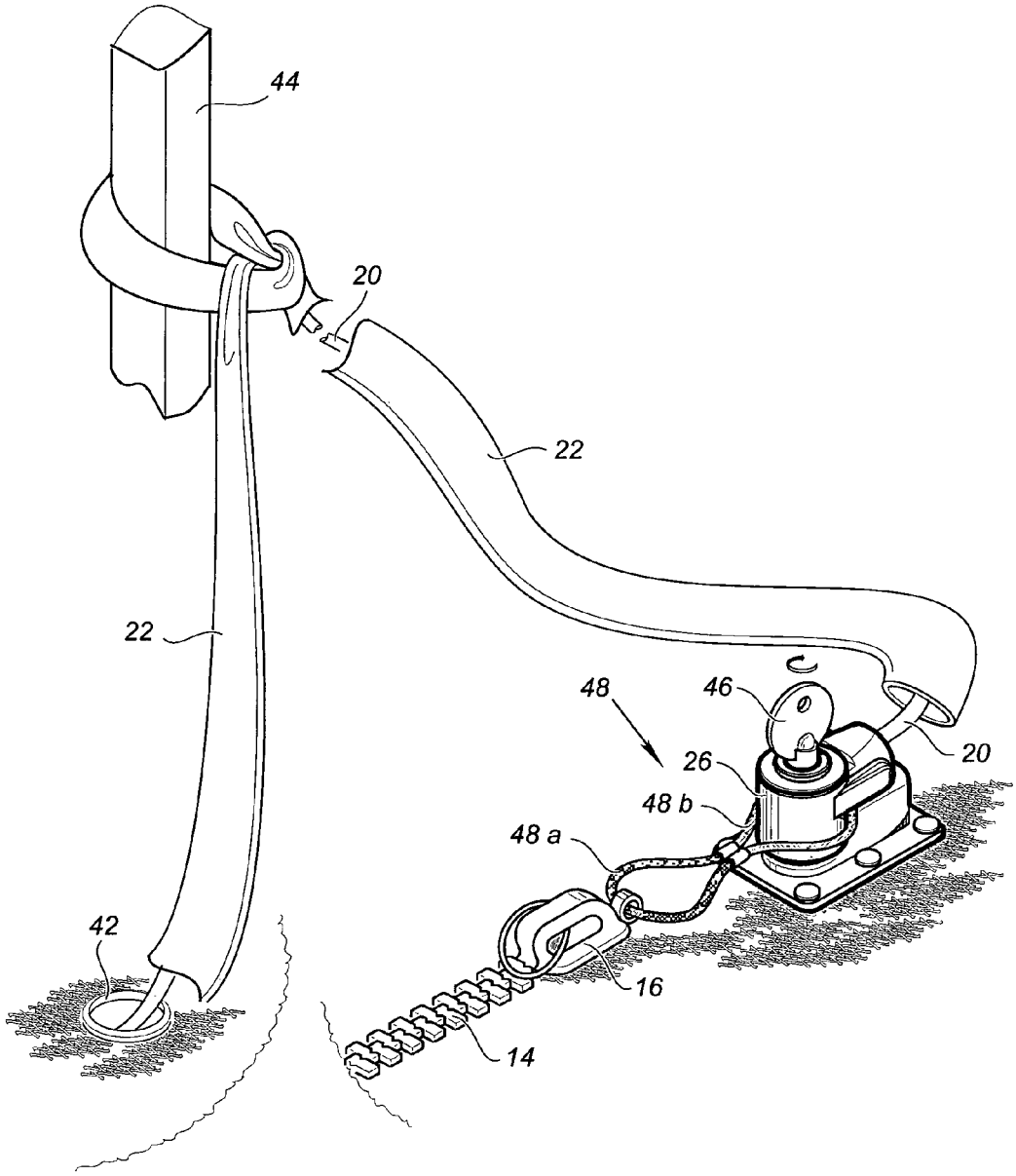
FIG. 3*b* shows the completion of the stage of FIG. 3*a;*

Further comprised is a double-looped, strong wire 48. One loop 48*a* is connected to the zipper-rider 16, while the other 48*b* is big enough to embrace the body of the lock 26, as seen in FIG. 3*b*.

Obviously, the double-looped wire arrangement is but one out of many equivalent design options.

The use of the invention as so far exemplified is self-explanatory. Let us assume that the owner of the laptop computer carrying bag 10 takes, for example, a seat in a restaurant and wants to make sure that the bag stays where it is left, namely at the side or under his/her table. If the bag is carried on ones shoulder, he/she should first unlock the lock 26, wind or otherwise tie the shoulder-strap 22 around the table-leg 44 or any other accessible fixed object (see FIG. 1), and re-lock the lock 26 through the loop 48*b*. Thus, the bag 10 as a whole stays protected, including the computer 12 stored therein.

Figures 4A, 4B, 4C:
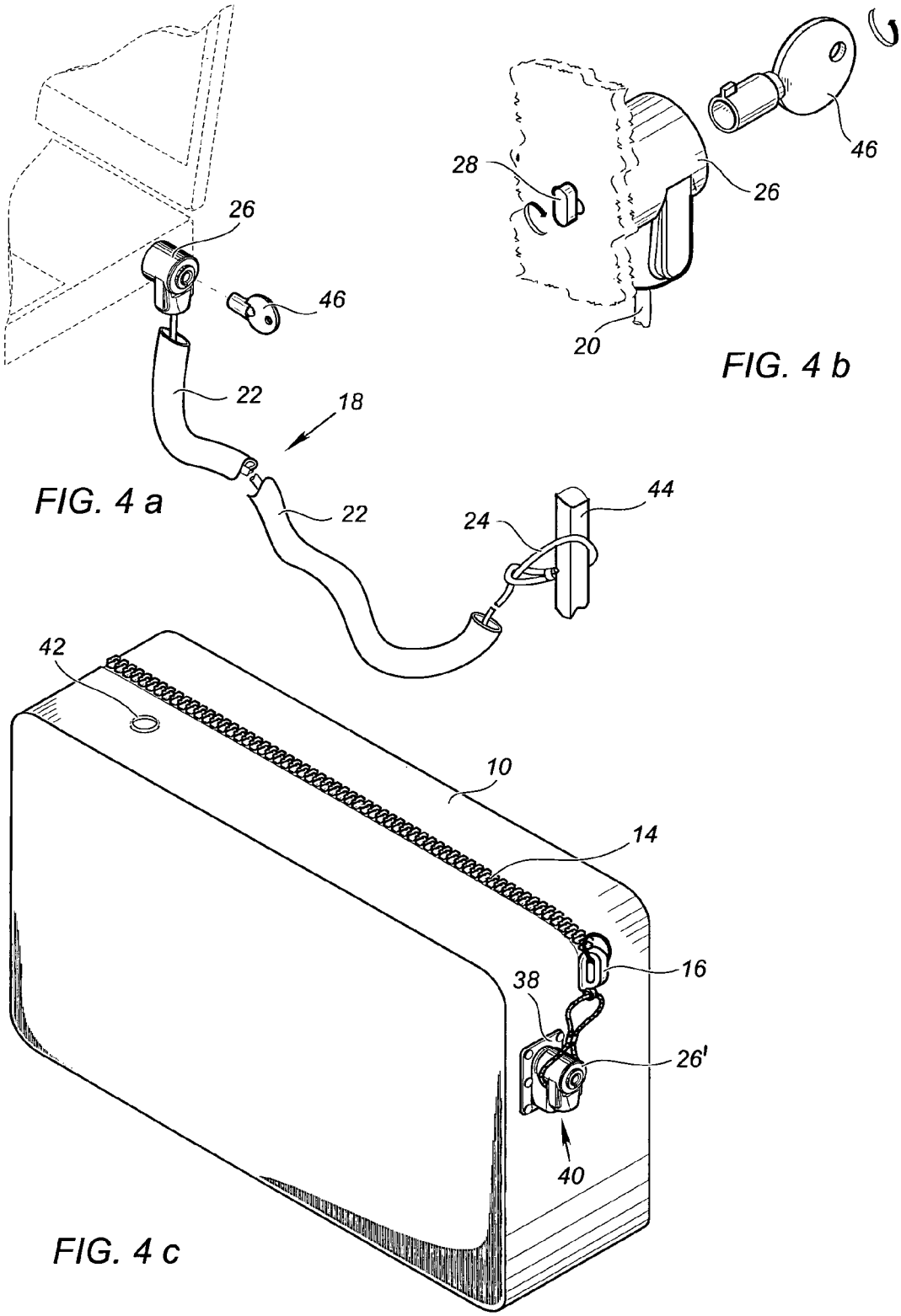
FIG. 4*a* depicts the shoulder-strap of FIG. 2 used for arresting a portable computer against a fixed object according to another aspect of the invention.
FIG. 4*b* shows the function of the designated slot in the embodiment of FIG. 4*a;*
FIG. 4*c* shows the bag of FIG. 1 when the shoulder strap is separately used as in FIG. 4*a*.

According to another, important aspect of the present invention, the shoulder-strap 18 can be used separately the same way as conventional security cables are used, as depicted in FIGS. 4*a* and 4*b*. In this case, the bag can also be secured against unauthorized opening (not against theft), by using another locking device 26', as depicted in FIG. 4*c*.

Figure 5:
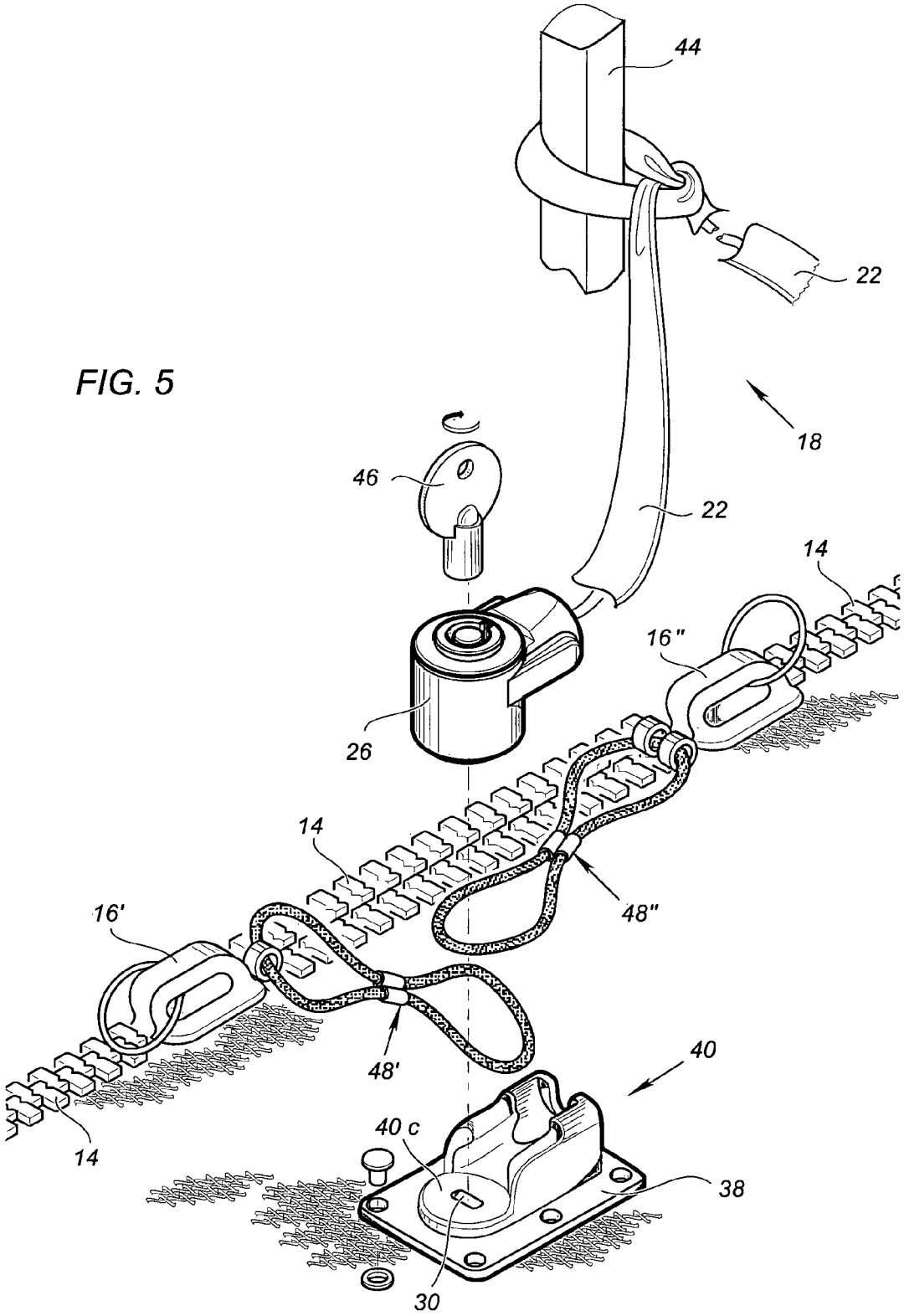
FIG. 5 illustrates the application of the shoulder-strap locking device for securing a pair of zipper-riders.

Finally, FIG. 5 differs from FIG. 3*a* only in that the zipper 14 is provided with two zipper-riders 16' and 16" as frequently found in commercial carrying bags.

In such cases, the two riders, each with its double-looped wire 48' and 48", are brought together down to the location where the second base plate 38 is mounted, and the lock 26 is used to hold them together the same way as in the former embodiment.

Those skilled in the art to which this invention pertains will readily appreciate that numerous changes, variations and modifications can be effectuated without departing from the true spirit and scope of the invention as defined in and by the appended claims.

What is claimed is:

1. A carrying bag with a shoulder-strap and a zipper with at least one zipper-rider for closing/opening the bag, the shoulder-strap has a loop at one end and a permanently attached, key-operated locking device at the other end thereof, a latch ring inside the carrying bag for holding, in a manually releasable manner, the loop of the shoulder strap to an inside wall of the bag, and a wire with a loop configured for securing said at-least one zipper-rider by said locking device to an outside wall of the bag for preventing the un-zipping of the bag, the shoulder strap being manually releasable at both ends thereof from the bag for use separately from the bag.

2. The bag of claim 1 wherein the locking device comprises a T-shaped tip rotatable by a key between locked and unlocked positions, and further including a rigid, plate-like member, having a slot through which the said tip is configured to be passed and rotated into the locked position.

3. The bag of claim 2 wherein the shoulder-strap is strengthened against cutting by a cutting tool.

4. The bag of claim 3 wherein the shoulder-strap is strengthened by durable fibers woven to the material of the strap.

5. The bag of claim 3 wherein the shoulder-strap comprises a sheath and a steel cable passed therethrough.

6. The bag of claim 3 wherein the shoulder-strap is passed through an eyelet installed at a top-wall of the bag, inside the bag.

7. The bag of claim 2 wherein the wire with the loop is connected to the rider and adapted to be tied by said locking device to the plate-like member.

8. The bag of claim 2 wherein the T-shaped tip is configured to be locked against a designated slot of commercially available portable computers.

* * * * *